United States Patent [19]

Rodgers et al.

[11] Patent Number: 4,555,826

[45] Date of Patent: Dec. 3, 1985

[54] HYDRAULIC CONTROL SYSTEM FOR VACUUM SWEEPER TRUCKS

[76] Inventors: Jack Rodgers, P.O. Box 1033, Redding, Calif. 96099; Mark F. Rodgers, 3745 Churn Creek Ave., #1, Redding, Calif. 96001

[21] Appl. No.: 627,429

[22] Filed: Jul. 3, 1984

[51] Int. Cl.[4] ..... E01H 1/08

[52] U.S. Cl. ..... 15/340; 15/339

[58] Field of Search ..... 15/340, 349, 346, 339, 15/319

[56] References Cited

U.S. PATENT DOCUMENTS

| | | | |
|---|---|---|---|
| 3,691,579 | 9/1972 | Kasper | 15/340 X |
| 3,744,653 | 7/1973 | Jensen | 15/340 X |
| 4,138,756 | 2/1979 | Krier et al. | 15/340 X |
| 4,193,159 | 3/1980 | Beard | 15/346 X |

*Primary Examiner*—Chris K. Moore

*Attorney, Agent, or Firm*—Paul L. Hickman

[57] ABSTRACT

A hydraulic control system for a vacuum sweeper truck including a hydraulic pump coupled to the truck's engine, a reservoir of hydraulic fluid, a hydraulic fan motor, a hopper actuator, and a valve assembly having three operative positions. In a first position the hopper actuator is deactivated and full power goes to the vacuum fan motor. In a second position the hydraulic fluid is diverted to the hopper actuator to raise the hopper and the vacuum fan motor is run at a reduced speed by hydraulic fluid returning to the reservoir. In a third position, the hydraulic fluid is again diverted to the hopper actuator to drive the hopper in a second direction, and again the fan motor is run at a reduced power level. A compensator is coupled to the hydraulic pump and is responsive to a cut-off setting and to the hydraulic pressure produced by the pump. A pressure adjustment means is provided in the cab of the truck which is coupled to the flow regulator to permit the truck operator to vary the cut-off setting of the flow regulator.

7 Claims, 4 Drawing Figures

HYDRAULIC CONTROL SYSTEM FOR VACUUM SWEEPER TRUCKS

BACKGROUND OF THE INVENTION

1. Field of the Invention

This invention relates generally to hydraulic control systems and more particularly to hydraulic control systems for utility vehicles.

2. Description of the Prior Art

To keep streets, parking lots, etc. free of debris and refuse motorized street sweepers are often used. Usually, the street sweeper apparatus is mounted on a truck's body, and includes a number of rotary sweeper brushes which engage the ground surface beneath the truck to propel the debris towards a conveyor system which deposits it into a hopper or other container. Some street sweepers include vacuum pickup heads as conveyors to draw the debris from the road surface and to deposit it in the hopper.

Hydraulics have been commonly used to control the position of the brooms, hopper, etc. Hydraulic actuators require a pressurized source of hydraulic fluid which, in turn, implies a hydraulic pump coupled to a power source. The most logical power source is the truck's internal combustion engine, although it is not always used for reasons to be discussed subsequently.

A major reason that a truck's internal combustion engine is often not used for powering a hydraulic pump is that the engine doesn't produce enough power at idling speeds to adequately pressurize the hydraulic fluid. One solution to this problem is to either manually or automatically increase the R.P.M. of the truck's engine until the hydraulic lines are sufficiently pressurized to power the actuators. This, however, tends to be wasteful and inefficient in that it results in high fuel consumption and in rapid wear of the engine's components.

Another problem with powering a hydraulic pump from the truck's engine is that the output of the pump will vary with the engine R.P.M. as the truck accelerates and decelerates. A prior art solution to this problem has been to automatically regulate the pump's output in response to operating conditions. For example, in U.S. Pat. No. 4,343,060, of Hildebrand et. al., means are used for electronically sensing the rotational speed of the sweeping components, and then feeding the speed signal into an electronic computing and control unit which sends electric power to an electric displacement control valve on a variable and reversible flow piston pump. Such control system, however, are complex and tend to raise the cost of the street sweeper dramatically.

Yet another problem with powering a hydraulic pump from a truck's engine is that the high starting load on the hydraulic pump will often kill the truck's engine. Prior art solutions to this problem include racing the truck's engine, which is very wasteful of fuel, or providing complex pump regulating devices such as that disclosed by Hildebrand et. al.

An alternative method for powering the hydraulic pump is to provide an auxiliary internal combustion engine mounted at a convenient location on the truck's body. This auxiliary engine would run at a relatively high, constant R.P.M. to power the hydraulic pump. Auxiliary engines, however, are expensive, and again tend to be wasteful of fuel since they are in continuous operation.

SUMMARY OF THE INVENTION

An object of this invention is to provide a hydraulic control system for a vacuum sweeper truck which can be efficiently powered by the internal combustion engine of the truck.

Another object to this invention is to provide a hydraulic control system which can be adjusted to sweep various terrains in an efficient manner.

Briefly, the invention comprises a hydraulic pump coupled to the internal combustion engine of the truck, a reservoir of hydraulic fluid coupled to an input port of the hydraulic pump, a hydraulic fan motor having an output port coupled to the reservoir, a pair of bi-directional hopper actuators, and a valve assembly having three operative positions. A first position of the valve assembly couples the output port of the pump to the input port of the fan motor. A second position of the valve assembly couples the output port of the pump to first ports of the hopper actuators and couples second ports of the hopper actuators to the input port of the fan motor. A third position of the valve assembly couples the output port of the pump to the second ports of the hopper actuators and couples the first ports of the hopper actuators to the input port of the fan motor.

Preferably, the hydraulic control system also includes a compensator responsive to a cut-off setting and to the hydraulic pressure at the output port of the hydraulic pump. The compensator is operative to maintain the hydraulic pressure on the pressurized lines at a level determined by the cut-off setting. The cut-off setting can be conveniently changed from the cab of the truck by means of a rotary coupling so as to vary the power delivered to the sweepers, pick-up head, hopper actuators, etc. in response to varying terrains and types of debris to be collected.

An advantage of this invention is that expensive electronic control circuits, reversible hydraulic pumps, and auxiliary engines are not required.

Another advantage of this invention is that the pump produces sufficient hydraulic pressure even when the truck's engine is idling.

Yet another advantage of this invention is that the power output of the hydraulic devices can be manually controlled by the truck's operator from the cab of the truck.

A still further advantage of this invention is that constant hydraulic pressure and flow can be maintained with varying engine speeds.

These and other objects and advantages of the present invention will no doubt become apparent upon a reading of the following descriptions and a study of the several figures of the drawing.

DETAILED DESCRIPTION OF THE PREFERRED EMBODIMENT(S)

Figure 1:
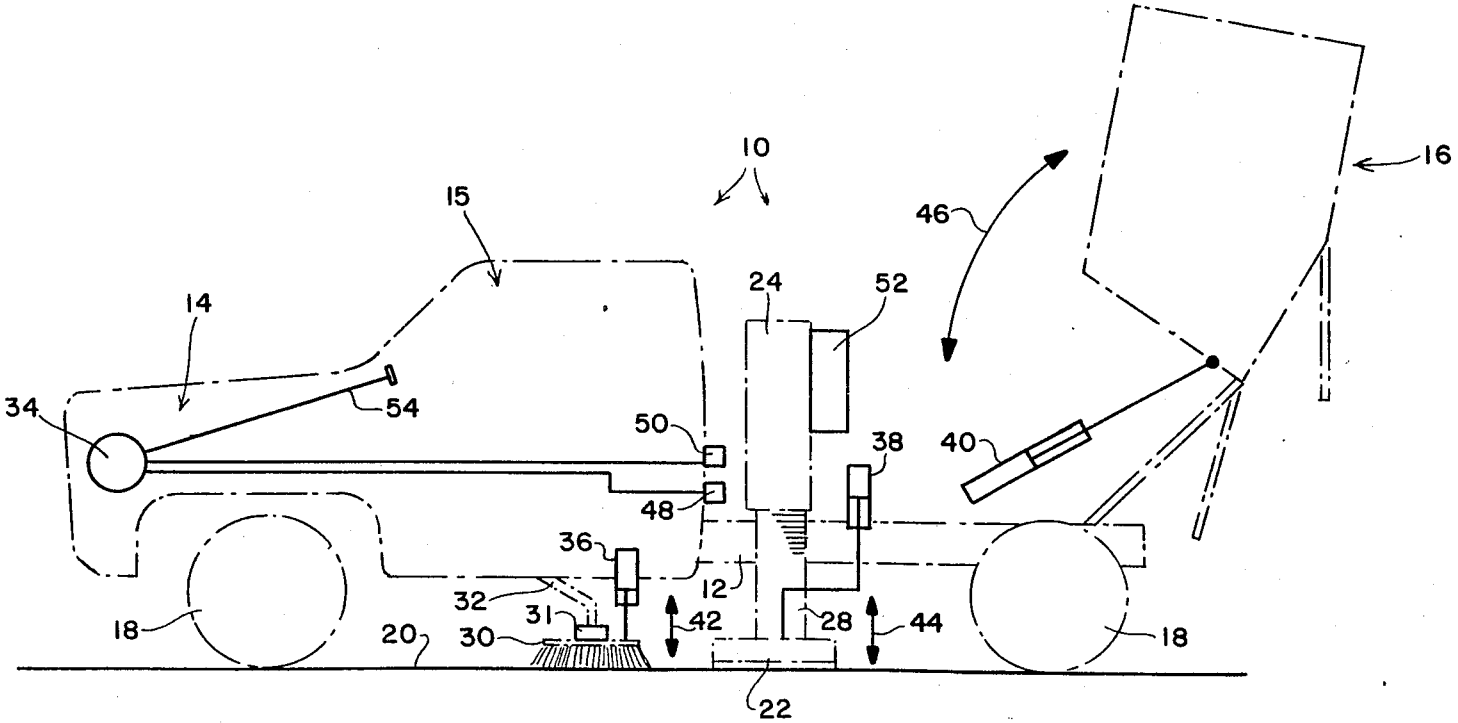
FIG. 1 is a side elevation of a vacuum sweeper truck, shown in phantom, which illustrates the approximate location of some of the components of the hydraulic control system of the present invention.

Referring to FIG. 1, a vacuum sweeper truck 10 (shown in phantom) includes a truck frame 12, an engine compartment 14, a cab 15, a dumping hopper 16, and wheels 18 in contact with the ground surface 20. Attached to truck frame 12 is a vacuum pickup head 22, a vacuum pump 24, and a flexible conduit 28 coupling the vacuum pump 24 to pickup head 22. Also attached to frame 12 are one or more sweeper brooms 30 which are rotated by broom motors 31. The brooms 30 and broom motors 31 are supported by pivoting links 32.

The hydraulic control system of the present invention includes a hydraulic pump 34, a broom actuator 36, a vacuum pickup head actuator 38, and a hopper actuator 40. Actuator 36 causes broom 30 to move up and down as indicated at 42, actuator 38 causes vacuum pickup head 22 to move up and down as indicated by arrow 44, and actuator 40 causes hopper 16 to pivot between a loading and a dumping position as indicated by arrow 46.

The hydraulic control system also includes a pair of valve assemblies 48 and 50, and a hydraulic fan motor 52. An adjustment mechanism 54 is provided in the cab 15 of truck 10 to allow the truck's operator to conveniently reset the output pressure of pump 34.

Figure 2:
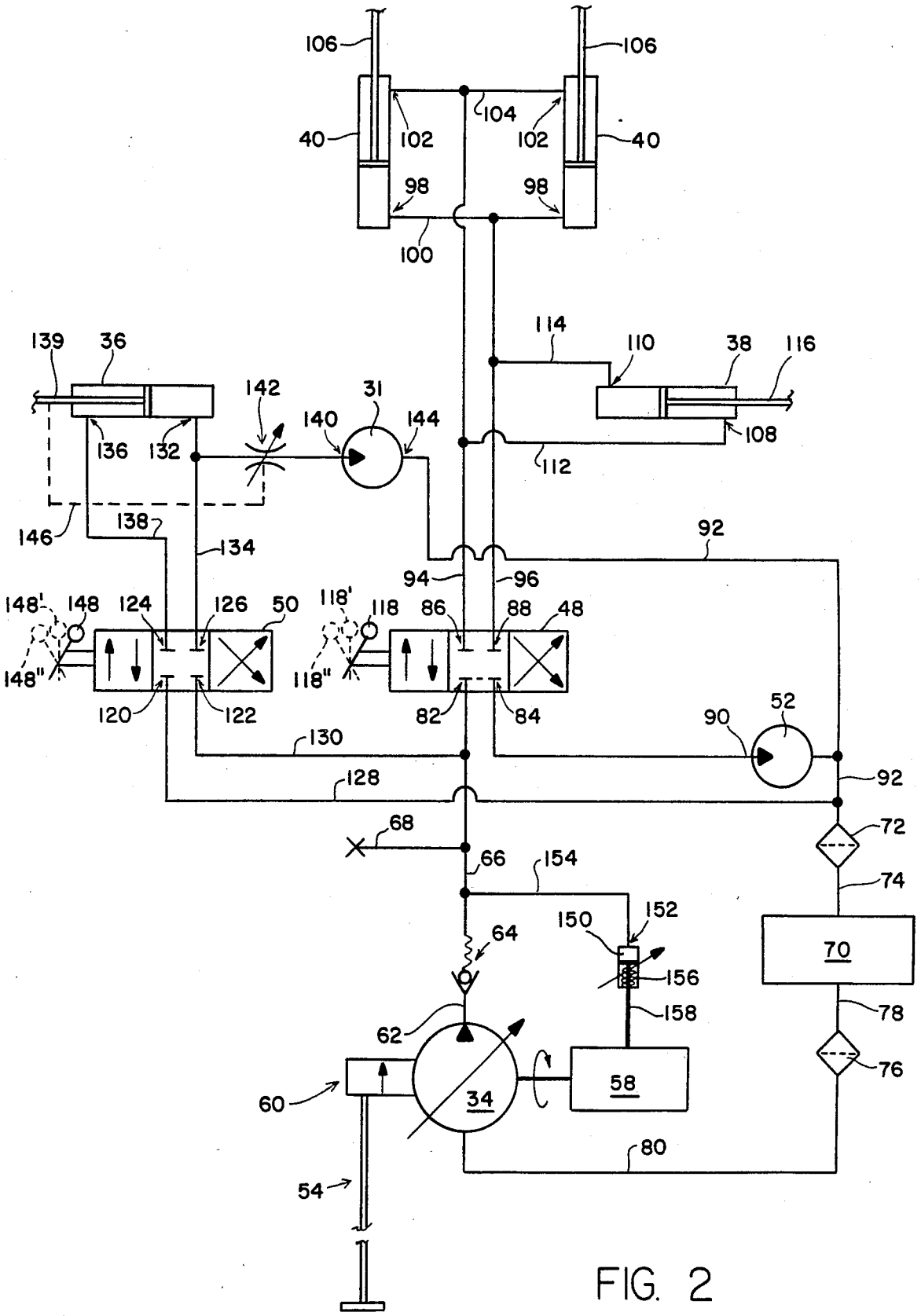
FIG. 2 is a schematic of the hydraulic control system of the present invention.

With reference to FIG. 2, the interconnection of the components of hydraulic control system will be discussed. The hydraulic pump 34 is coupled to the internal combustion engine 58 of truck 10. Pump 34 is preferably a variable, in-line piston unit such as the PVE21 manufactured by the Sperry Vickers Company of Troy, Mich. As will be discussed in greater detail subsequently, integrally formed with pump 34 is a pressure sensing flow regulator or (as it is often called) compensator 60 which maintains the pressure at an output port 62 of pump 34 at a level determined by the adjustment mechanism 54 of the present invention.

A spring loaded check valve 64 is coupled to output port 62, and opens when the pressure at output port 62 exceeds 100 P.S.I. Thus, hydraulic pressure line 66 remains unpressurized until the output of pump 34 exceeds 100 P.S.I., after which time the pressure on line 66 has a minimum pressure of 100 P.S.I., and has a maximum pressure set by the adjustment mechanism 54. This pressure can be monitored at a test port 68 with a pressure meter or the like.

An unpressurized reservoir 70 is provided to hold a supply of hydraulic fluid. An input filter 72 is coupled to the input line 74 of the reservoir and a filter 76 is coupled to an output line 78 of reservoir 70. A line 80 couples filter 76 to the input port of hydraulic motor 34.

Valve assembly 48 is preferably a three position, four way control valve having four ports 82, 84, 86, and 88. Port 82 is coupled to pressure line 66 and port 84 is coupled to the input port of a fan motor by a line 90. The output port of fan motor 52 is coupled to filter 72 by a line 92. Port 86 is coupled to a line 94, and port 88 is coupled to a line 96.

Hopper actuators 40 preferably include a first set of ports 98 coupled together by a line 100, and a second pair of ports 102 coupled together by a line 104. Line 104 is coupled to line 94, and line 100 is coupled to line 96. When line 94 is pressurized output shafts 106 of actuators 40 retract and when lie 96 is pressurized shafts 106 extend.

Pickup head actuator 38 also includes ports 108 and 110, where port 108 is coupled to line 94 by a line 112, and where port 110 is coupled to line 96 by a line 114. When line 94 is pressurized, the output shaft 116 is retracts, and when line 96 is pressurized shaft 116 extends.

Valve assembly 48 includes a selector lever 118 having three operative positions as illustrated at 118, 118', and 118''. When the selector switch is in the central position as illustrated at 118', ports 82 and 84 are coupled together such that the pressure lines 66 is coupled directly to the line 90 of fan motor 52. In this position, most of the power is provided to vacuum pump 24 (see FIG. 1) to provide maximum suction at pickup head(s) 22.

When the lever is pivoted to the position shown at 118'', ports 82 and 86 are coupled together and ports 84 and 88 are coupled together. This causes pressure line 66 to be coupled to line 94 retracting shafts 106 of actuators 40 and retracting shaft 116 of actuator 38. The movement of the actuator shafts cause the dumper hopper to pivot into its resting position against truck frame 12, and raises the vacuum pickup head from the ground 20. In this position, the sweeper truck is in its travel mode and may be driven normally on streets and highways.

By pivoting the lever to the position shown at 118, ports 82 and 88 are coupled together, and ports and 84 and 86 are coupled together. This causes pressure line 66 to be coupled to line 96 which will extend shafts 106 from the actuators 40, and will extend shaft 116 from actuator 38. In this position, the hopper is pivoted to its dumping position as illustrated in FIG. 1, and the vacuum pickup head is lowered to its operational position near ground level 20. As will be explained subsequently, actuator 38 can be be operated independently of actuators 40 by lowering the pressure on line 66 to a point insufficient to activate actuators 40.

When the lever is in either position 118 or 118'', line 90 will be coupled to the low pressure or return line from actuators 38 and 40. This results in reduced power being provided to fan motor 52 during the dumping operation.

Valve assembly 50 is also three position, four way control valve, although only two of the positions are operative, the third being a neutral position. The valve assembly 50 has four ports 120, 122, 124, and 126, where port 120 is coupled to line 92 by a line 128, and port 122 is coupled to pressure line 66 by a line 130.

Broom actuator 36 has a first port 132 coupled to port 126 of valve assembly 50 by a line 134, and a second port 136 coupled to port 124 of valve assembly 50 by a line 138. When line 134 is pressurized, a shaft 139 of actuator 36 is extended, and when line 138 is pressurized shaft 139 is retracted into actuator 36. An input port 140 of broom motor 31 is coupled to line 134 by a flow control valve 142. An output port 144 of broom motor 31 is coupled to line 92.

Flow control valve 142 has a variable orifice which is mechanically coupled by linkage 146 to shaft 139 of actuator 36. As shaft 39 extends from actuator 36, flow control valve 142 is opened to actuate broom motor 31. As shaft 139 retracts into actuator 36 the flow control valve 142 closes shutting off the broom motor. Thus, as broom 30 (see FIG. 1) is lowered into contact with ground 20 broom motor 31 is automatically activated, and as the broom is raised above ground level 20 the broom motor is de-activated.

Valve assembly 50 includes a three position control lever 148. When the control lever 148 is in the position shown in solid lines, ports 120 and 126 are coupled together, and ports 122 and 124 are coupled together. In this position, line 138 is pressurized causing shaft 139 to retract within actuator 36. When the lever is in the position shown at 148', none of the ports 120–126 are coupled together such that there is no connection between lines 128 and 130. When the lever is pivoted to the location shown at 148", ports 120 and 124 are coupled together, and ports 122 and 126 are coupled together. This causes line 134 to become pressurized which, in turn, causes shaft 139 to extend from actuator 36.

As an option, and only for the very smallest of engines, a throttle adjustment actuator 150 can be provided having an input port 152 coupled to pressure lines 66 by a line 154. An adjustable biasing spring 156 is provided within actuator 150 to adjust the pressure at which shaft 158 extends from actuator 150. Shaft 158 pushes against the throttle of engine 58 to maintain the R.P.M. of the engine at a constant level as the load on the engine increases.

As mentioned previously, one type of hydraulic pump 34 that can be utilized in the present invention is the model piston pump PVE21 produced by Sperry Vickers. In operation of the PVE21, rotation of a pump drive shaft causes a cylinder block, shoe plate, and piston to rotate. A number of piston shoes are held against the yoke face by the shoe plate. The angle of the yoke face imparts a reciprocating motion to each piston within the cylinder block. Inlet and outlet ports connect to a kidney slotted wafer plate. As the pistons move out of the cylinder block, a vacuum is created and fluid is forced into the void by atmospheric pressure. The fluid moves with the cylinder block past the intake kidney slot to the outlet (pressure) kidney slot. The motion of the piston reverses and the fluid is pushed out of the cylinder block into the outlet port.

Figure 3:
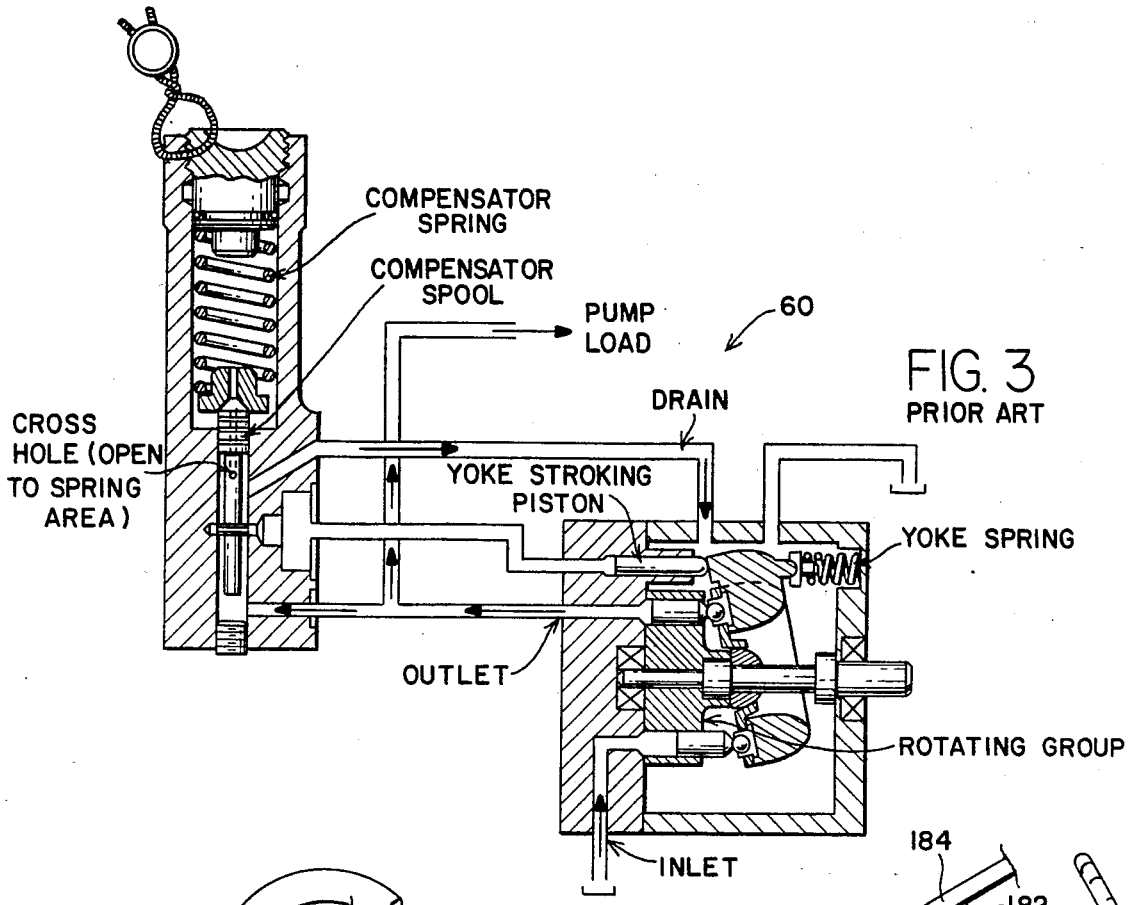
FIG. 3 PRIOR ART
FIG. 3 is a cross section of a prior art flat cut-off compensator for hydraulic pumps.

Referring now to FIG. 3, a prior art, flat cut-off flow compensator 60 which controls the output of the PVE21 is illustrated. The compensator 60 causes the pump to maintain a constant load pressure for all values of flow within the capacity of the pump providing the load is sufficient to build up pressure.

The operation of the compensator 60 is as follows. When a no-load condition exists, the pump will deliver maximum flow at zero pressure. As the actuator load increases, pressure will rise although the flow will remain at maximum until pressure reaches the compensator 60 spring setting (cracking pressure). As a further increase in load occurs, system pressure will cause the compensator spool to move against the compensator spring, metering flow to the yoke stroking piston. The yoke stroking piston then moves the yoke to reduce flow.

As flow is reduced, system pressure reduces slightly causing the compensator spool to return to the null position. At null, flow to the yoke stroking piston stops, as will the movement of the yoke, causing the flow to stabilize at a reduced value. If the load were to continue to increase, the pump flow will reduce to zero, and a deadhead pressure condition would exist. The pressure differential needed to cause the compensator spool to change from maximum flow (cracking pressure) to zero flow (deadhead pressure) is approximately 50 to 150 P.S.I.

Pump outlet flow is proportional to the control range from cracking pressure to deadhead pressure. For example, if cracking pressure is 2900 P.S.I. (maximum flow) and if deadhead pressure is 3000 P.S.I. (minimum flow), a pressure of 2950 P.S.I. would be equal to 50% of maximum flow.

If the load decreases, pressure will decrease proportionally and the compensator spring will move the spool down, opening the yoke stroking piston to the case drain. As fluid is metered from the yoke stroking piston, the yoke spring will stroke the yoke to increase flow. The increase in flow causes a proportional increase in system pressure. The increase in system pressure returns the compensator 60 spool to a null position and flow from the yoke stroking piston will stop, as will the movement of the yoke. The flow will stay constant until another change of load occurs.

If the load continues to decrease, pump flow will continue to increase, holding the outlet at compensator cracking pressure. When maximum flow is reached (at maximum stroke) a maximum flow and a maximum pressure condition exists. A further decrease in load will lower the outlet pressure until a final theoretical condition of maximum flow and zero pressure is obtained.

A problem with using the compensator of Sperry Vickers for vacuum sweeper trucks in its unmodified form is that the cracking pressure of the compensator 60 is set and sealed at the factory at the highest allowable working pressure, which is approximately 2000 P.S.I. Since the compensator 60 senses load pressure to adjust the flow of the pump and since the start-up pressure for the hydraulic loads of this invention are high, the unmodified compensator 60 will cause the pump to operate under a maximum load during pump start-ups, which will often kill the truck's engine. If the truck's engine were raced to avoid being killed, the hydraulic components would operate in an uncontrollable manner under the maximum (cracking) pressure.

Another problem with using an unmodified compensator 60 is that during highway travel the flow to the hydraulic loads should be shut off, requiring a valve of some sort on the pressure line 66. The back pressure caused by the shut off valve would be sensed by the compensator 60 which would cause the pump to operate at maximum pressure. This would cause a considerable drag on the truck's engine, causing high fuel bills and considerable engine wear, and would result in massive heat losses in the system.

Figure 4:
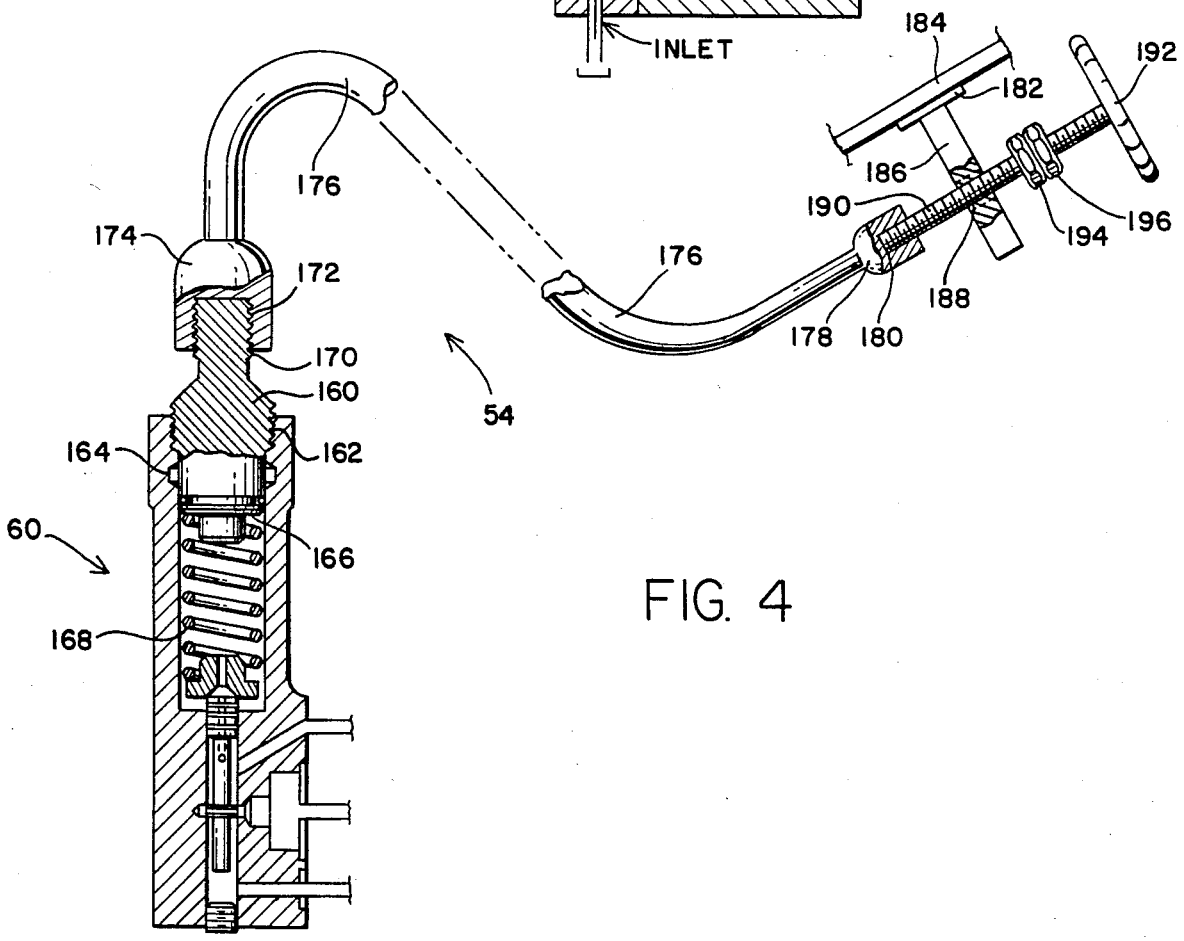
FIG. 4 is a perspective view of a modification of the present invention which permits the cut-off of the prior art compensator to be reset from the cab of the truck.

Referring now to FIG. 4, adjustment mechanism 54 modifies the Sperry Vickers compensator 60 to permit the cracking pressure of the compensator 60 to be reset from the cab 15 of the vacuum sweeper truck 10. Adjustment mechanism 54 includes a cap member 160 having threads 162 engaging threads provided in the housing 164 of compensator 60. A lower end 166 of cap member 160 forms a shoulder for engagement with compensator spring 168.

An upper end of cap member 160 is provided with threads 170 which engages a threaded bore 172 of a lower end 174 of a flexible cable 176. An upper end 178 of cable 176 is provided with a threaded bore 180. Cable 176 rotates such that a torsion force applied to upper end 178 is transmitted by cable 176 to lower end 174 with very little loss.

Adjustment mechanism 54 further includes a mounting plate 182 which attaches to a portion of the dashboard assembly 184 of the truck 10 within cab 15, and a support 186 attached at substantially right angles to the mounting plate 182. Support 186 is provided with a threaded bore 188.

A screw 190 has a first end engaged with threaded bore 180 of cable 176, a central portion engaged with threaded bore 188 of support 186, and a second end attached to knob 192. A pair of stop nuts 194 and 196 are threaded onto screw 190.

As knob 192 is rotated, cable 176 is caused to rotate, adjusting the position of cap member 160 within housing 164. The movement of the shoulder formed by the lower end 166 of cap member 160 adjusts the compression of spring 168 to set the cracking pressure of compensator 60. The end surface of upper end 178 of the cable 176 and the nuts 194/196 determine the minimum and maximum cracking pressure by limiting the rotation of screw 190.

Before starting the truck's engine, the cracking pressure of compensator 60 is set to a low level by rotating knob 192 in a counter-clockwise direction. After the truck's engine is idling smoothly, the cracking pressure is increased by rotating the knob 192 in a clockwise direction until the pressure on line 66 is sufficient for the job at hand. For freeway and road travel, the cracking pressure of compensator 60 is again set to a low level to avoid energy (heat) losses in the pump 34.

To raise and lower pickup head(s) 22 without moving the hopper 16, knob 192 is rotated until the pressure on line 66 is sufficient to activate actuator 38 but is less than sufficient to activate actuators 40. This is possible because the energy required to move hopper 16 is much greater than the energy required to move the relatively lightweight pickup head(s) 22. Thus, the combination of adjustment mechanism 54 and valve assembly 48 permits the pickup head(s) 22 to be controlled independently of the dumping hopper 16.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A hydraulic control system for a vacuum sweeper truck of the type including an internal combustion engine for propelling said truck, a cab within which the vehicle operator may sit, a vacuum pick-up head, a rotary sweeper mechanism for directing refuse to said vacuum pick-up head, and a dumping hopper movable between a loading and a dumping position, said hydraulic control system comprising:

a hydraulic pump having an input port and an output port, said hydraulic pump being coupled to said internal combustion engine;

a reservoir of hydraulic fluid having an output port coupled to said input port of said hydraulic pump;

a hydraulic fan motor adapted to power a vacuum pump which provides vacuum to said vacuum pick-up head, said fan motor having an input port and an output port, said output port of said fan motor being coupled to an input port of said reservoir;

a hopper actuator having a pair of ports, where applying pressure to a first port causes said hopper to move towards said dumping position and where applying pressure to a second port causes said hopper to move towards said loading position; and first valve means having three operative positions, where a first position couples said output port of said pump to said input port of said fan motor, a second position couples said output port of said pump to said first port of said hopper actuator and couples said second port of said hopper actuator to said input port of said fan motor, and a third position couples said output port of said pump to said second port of said hopper actuator and couples said first port of said hopper actuator to said input port of said fan motor.

2. A hydraulic control system as recited in claim 1 further comprising:

a compensator responsive to a cut-off setting and to the hydraulic pressure at said output port of said hydraulic pump, said flow regulator being operative to maintain said hydraulic pressure at said output port at a level determined by said cut-off setting; and pressure adjustment means provided in said cab of said truck which is coupled to said flow regulator to permit said vehicle operator to vary the cut-off setting of said flow regulator.

3. A hydraulic control system as recited in claim 2 further comprising a pick-up head actuator having a pair of ports, where applying pressure to a first port causes said pick-up head to move towards the ground surface beneath said truck, and where applying pressure to a second port causes said pick-up head to move away from said ground surface, said first port of said pick-up head actuator being coupled to said first port of said hopper actuator, and said second port of said pick-up head actuator being coupled to said second port of said hopper actuator.

4. A hydraulic control system as recited in claim 3 further comprising:

a broom actuator having a pair of ports, where applying pressure to a first port causes said broom to move towards the ground surface beneath said truck, and where applying pressure to a second port causes said broom to move away from said ground surface; and second valve means having two operative positions, where a first position couples said output port of said pump to said first port of said broom actuator and said second port of said broom actuator to said second port of said fan motor, and where a second position couples said output port of said pump to said second port of said said broom actuator and said first port of said broom actuator to said second port of said fan motor.

5. A hydraulic control system as recited in claim 4 further comprising:

a variable flow restrictor having an input port coupled to said first port of said broom actuator and an output port; and a broom motor having an input port coupled to the output port of said restrictor and having an output port coupled to said input of said reservoir.

6. A hydraulic control system as recited in claim 5 further comprising means linking said variable flow restrictor to said broom such that as said broom is lowered by said broom actuator said flow restrictor opens, and as said broom is raised by said broom actuator said flow restrictor closes.

7. A hydraulic control system as recited in claim 6 further comprising a throttle actuator responsive to the pressure at said output port of said pump and operative to control the throttle position of said internal combustion engine.

* * * * *